US009659554B1

(12) United States Patent
Determan

(10) Patent No.: US 9,659,554 B1
(45) Date of Patent: May 23, 2017

(54) WHISTLE/BOTTLE-OPENER SYSTEM

(71) Applicant: Thomas W. Determan, Lakeland, FL (US)

(72) Inventor: Thomas W. Determan, Lakeland, FL (US)

( * ) Notice: Subject to any disclaimer, the term of this patent is extended or adjusted under 35 U.S.C. 154(b) by 0 days.

(21) Appl. No.: 15/197,220

(22) Filed: Jun. 29, 2016

Related U.S. Application Data

(63) Continuation-in-part of application No. 14/817,617, filed on Aug. 4, 2015, now abandoned, which is a continuation-in-part of application No. 14/540,736, filed on Nov. 13, 2014, now abandoned.

(60) Provisional application No. 62/043,487, filed on Aug. 29, 2014.

(51) Int. Cl.
*G10K 5/00* (2006.01)
*B67B 7/16* (2006.01)

(52) U.S. Cl.
CPC . *G10K 5/00* (2013.01); *B67B 7/16* (2013.01)

(58) Field of Classification Search
CPC .... G10K 5/00; A63H 5/00; B67B 7/16; B67B 7/44; A01M 31/004
See application file for complete search history.

(56) References Cited

U.S. PATENT DOCUMENTS 711,090 A * 10/1902 Zilkie ..... A63H 33/40 446/202
1,133,713 A * 3/1915 Dressler ..... G10K 5/00 446/206
2,388,495 A * 11/1945 Osterholt ..... G10K 5/00 446/204
2,621,550 A * 12/1952 Bach ..... B24B 21/00 7/151
D194,157 S * 11/1962 Thomas ..... 30/446
3,722,348 A * 3/1973 Visser ..... G10D 7/023 84/380 C
3,751,743 A * 8/1973 Buck ..... B67B 7/44 7/151
4,309,921 A * 1/1982 Miller ..... B67B 7/44 220/274
4,412,464 A * 11/1983 Cook ..... B67B 7/403 7/151
4,490,123 A * 12/1984 Becker ..... A63H 5/00 281/15.1
4,864,898 A * 9/1989 Tricinella ..... B67B 7/44 81/3.09
4,918,775 A * 4/1990 Leu ..... G02B 23/16 362/119
D311,878 S * 11/1990 Mingus ..... D10/119.2
5,077,850 A * 1/1992 Brubaker ..... A44B 15/005 224/163

(Continued)

*Primary Examiner* — Aarti B Berdichevsky
*Assistant Examiner* — Urszula M Cegielnik

(57) ABSTRACT

An upper plate and a similarly configured lower plate each have a serpentine forward edge, a linear rearward edge, a left edge, a right edge, an upper surface, and a lower surface. The upper and lower plates each have a whistle section and a laterally spaced bottle-opener section. A C-shaped bend couples the upper and lower plates. An upper hole extends through the upper plate in the whistle section. An axially aligned lower hole extends through the lower plate in the whistle section. A J-shaped notch extends through the upper plate and the lower plate and the C-shaped bend at the rearward edge in the bottle-opener section.

1 Claim, 3 Drawing Sheets

(56) References Cited

U.S. PATENT DOCUMENTS 5,313,376 A * 5/1994 McIntosh ..... F21V 33/0084 362/119
6,105,468 A * 8/2000 Fohrman ..... B67B 7/44 81/3.09
6,199,452 B1 * 3/2001 Vinar ..... B67B 7/14 81/3.36
D439,860 S * 4/2001 Lynn ..... D10/119.2
D447,076 S * 8/2001 Matlock ..... D10/119.3
6,273,582 B1 * 8/2001 Taggart ..... B25F 1/003 362/119
D458,098 S * 6/2002 Hastings ..... D27/142
6,489,545 B1 * 12/2002 Hart ..... G10K 5/00 446/202
6,619,225 B1 * 9/2003 Presniakov ..... B26B 11/001 116/137 R
7,171,831 B2 * 2/2007 Matthews ..... A44B 15/005 7/151
7,234,639 B2 * 6/2007 Schultz ..... G10K 5/00 116/24
D613,197 S * 4/2010 Huang ..... D10/119.2
D638,323 S * 5/2011 Nevels ..... D10/119.3
2003/0208850 A1 * 11/2003 Tague ..... B67B 7/92 7/151
2004/0079275 A1 * 4/2004 Falla ..... G10K 5/00 116/202
2004/0083552 A1 * 5/2004 Abrahall ..... B67B 7/44 7/151
2005/0076742 A1 * 4/2005 Yurek, Jr. ..... B67B 7/24 81/3.55
2006/0272568 A1 * 12/2006 Neidlinger ..... G10K 5/00 116/137 R
2008/0307584 A1 * 12/2008 Jones ..... B25C 3/008 7/151
2009/0025513 A1 * 1/2009 Salvino ..... B67B 7/44 81/3.57

* cited by examiner

FIG. 1
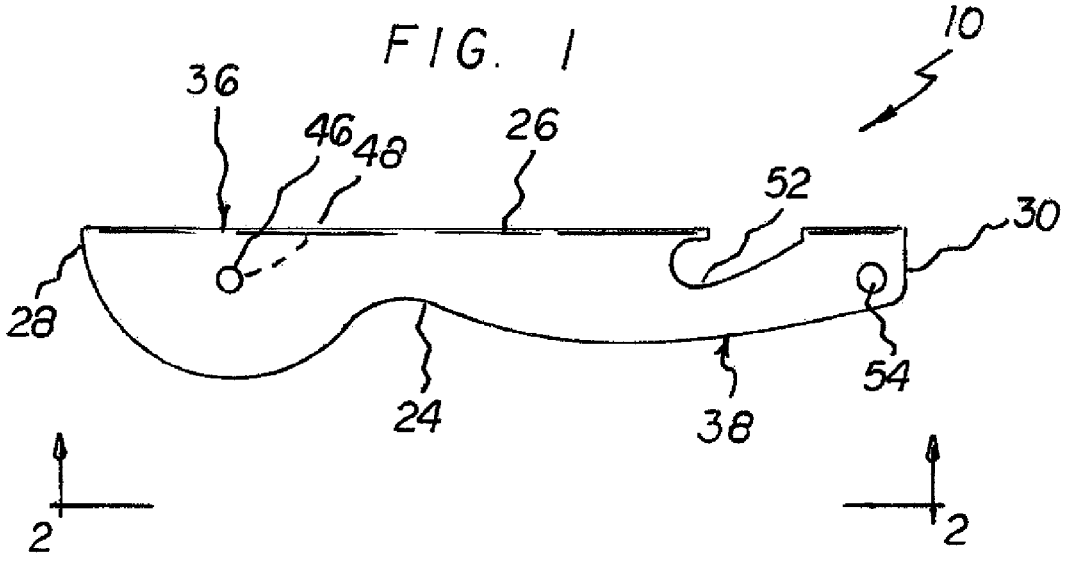
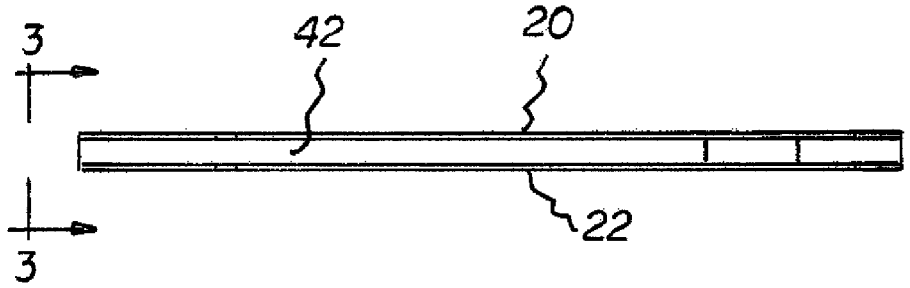
FIG. 2

FIG. 3
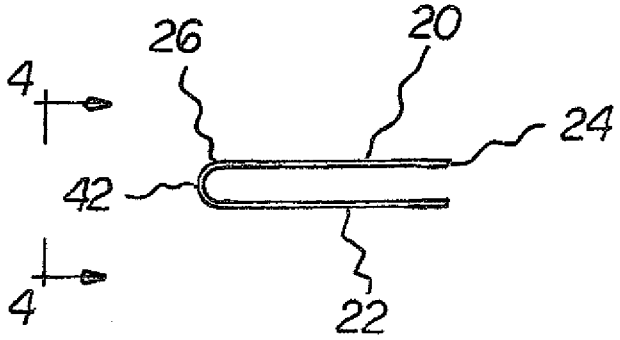
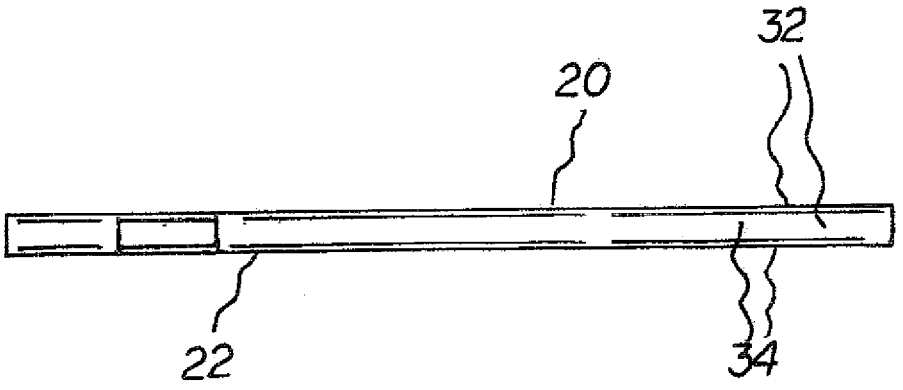
FIG. 4

FIG. 5
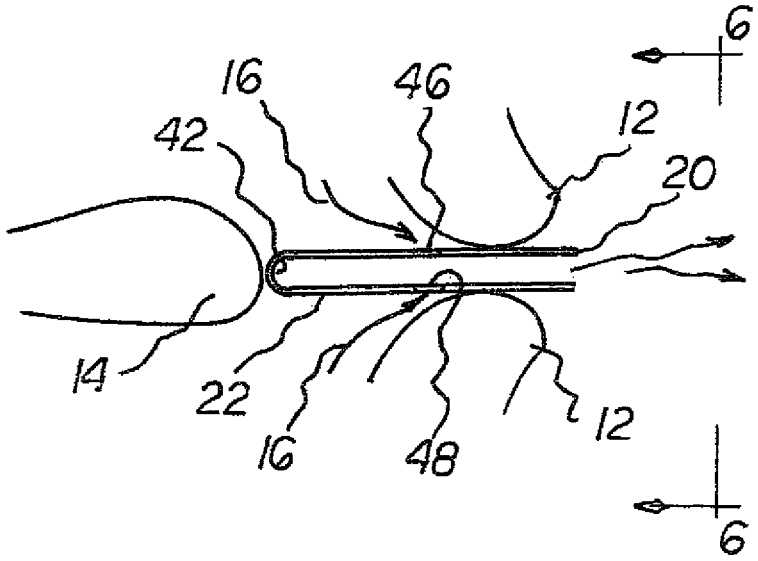
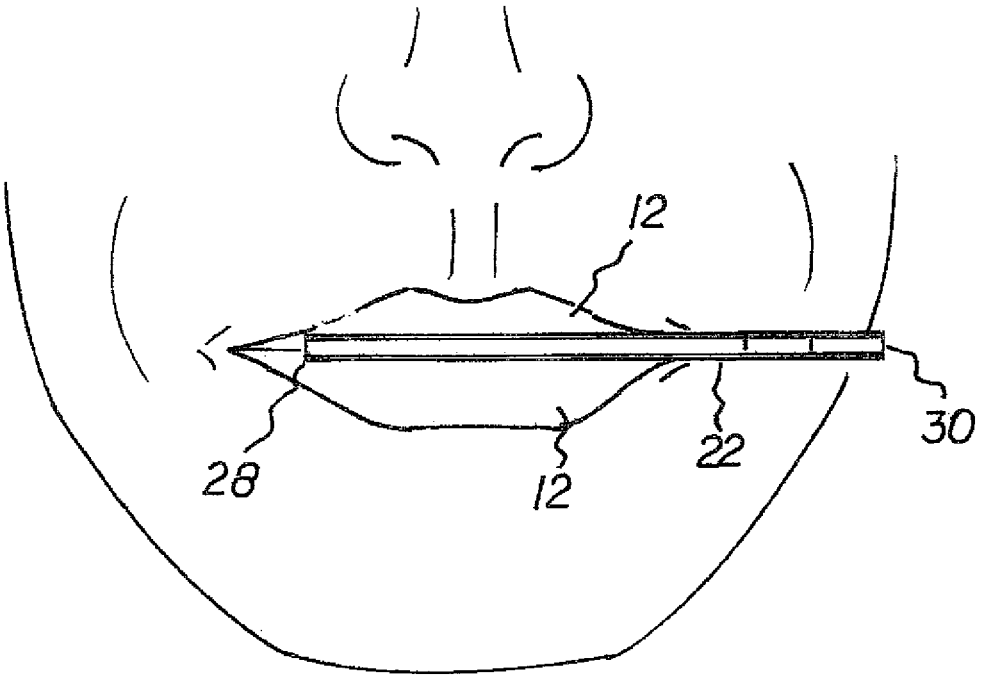
FIG. 6

WHISTLE/BOTTLE-OPENER SYSTEM

RELATED APPLICATION

The present application is a continuation-in-part of pending application Ser. No. 14/817,617 filed Aug. 4, 2015 which is a continuation in part of application Ser. No. 14/540,736 filed Aug. 29, 2014, the subject matter of which applications is incorporated herein by reference.

BACKGROUND OF THE INVENTION

Field of the Invention

The present invention relates to a whistle/bottle-opener system and more particularly pertains to being used as a whistle when supported between lips of a user adjacent to a tongue of the user while flowing a stream of air through the whistle and out of a mouth of the user, the system adapted to be used for opening bottles, the supporting and flowing and opening being done in a safe, convenient, and economical manner.

SUMMARY OF THE INVENTION

In view of the foregoing disadvantages inherent in the known types of bottle-openers of known designs and configurations now present in the prior art, the present invention provides an improved whistle/bottle-opener system. As such, the general purpose of the present invention, which will be described subsequently in greater detail, is to provide a new and improved whistle/bottle-opener system and method which has all the advantages of the prior art and none of the disadvantages.

From a broad viewpoint, the present invention is a whistle/bottle-opener system. An upper plate and a similarly configured lower plate are provided. The upper and lower plates each have a serpentine forward edge, a linear rearward edge, a left edge, a right edge, an upper surface, and a lower surface. The upper and lower plates each have a whistle section. The upper and lower plates each have a laterally spaced bottle-opener section. A C-shaped bend couples the rearward edges of the upper and lower plates. An upper hole extends through the upper plate in the whistle section. An axially aligned lower hole extends through the lower plate in the whistle section. A J-shaped notch extends through the upper plate and the lower plate and the C-shaped bend at the rearward edge in the bottle-opener section.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved whistle/bottle-opener system which has all of the advantages of the prior art bottle-openers of known designs and configurations and none of the disadvantages.

It is another object of the present invention to provide a new and improved whistle/bottle-opener system which may be easily and efficiently manufactured and marketed.

It is a further object of the present invention to provide a new and improved whistle/bottle-opener system which is of durable and reliable constructions.

Lastly, another object of the present invention is to provide a whistle/bottle-opener system to be used as a whistle when supported between the lips of a user adjacent to the tongue of the user while flowing a stream of air through the whistle and out of the mouth of the user and to be used for opening bottles. The supporting and flowing and opening are done in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of a whistle/bottle-opener system constricted in accordance with the principles of the present invention.

FIG. 2 is a front elevational view taken along line 2-2 of FIG. 1.

FIG. 3 is a side elevational view taken alone line 3-3 of FIG. 2.

FIG. 4 is a rear elevational view taken along line 4-4 of FIG. 3.

FIG. 5 is a side elevational view of the whistle/bottle-opener system, the whistle/bottle-opener system being shown in an in-use operative orientation.

FIG. 6 is a front elevational view taken along line 6-6 of FIG. 5.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved whistle/bottle-opener system embodying the principles and concepts of the present invention and generally designated by the reference numeral 10 will be described.

The present invention, the whistle/bottle-opener system 10 is comprised of a plurality of components. Such components in their broadest context include an upper plate, a lower plate, a C-shaped bend, an upper hole, and a J-shaped notch. Such components are individually configured and correlated with respect to each other so as to attain the desired objective.

From a specific viewpoint, the present invention is a whistle/bottle-opener system. In the preferred embodiment, first provided are an upper plate 20 and a similarly configured lower plate 22. The upper and lower plates each have a serpentine forward edge 24. The upper and lower plates each have a linear rearward edge 26. The upper and lower plates each have a left edge 28 and a right edge 30. The upper and lower plates each have an upper surface 32 and a lower surface 34. The upper and lower plates each have a whistle section 36. The upper and lower plates each have a laterally spaced bottle-opener section 38. The forward edges are convex in an arcuate configuration with a first radius of curvature and a maximum distance is 0.875 inches between the forward and rearward edges in the whistle section. The forward edges are convex in an arcuate in configuration with a second radius of curvature greater than the first radius of curvature and a maximum distance of 0.750 inches between the forward and rearward edges in the bottle-opener section. The length of the bottle-opener section is between 25 percent and 35 percent greater than the whistle section.

A C-shaped bend 42 is next provided. The C-shaped bend couples the rearward edges of the upper and lower plates.

Further provided is an upper hole 46 extending through the upper plate in the whistle section. An axially aligned lower hole 48 is provided extending through the lower plate in the whistle section. The upper hole and the lower hole are each circular in configuration. The upper hole and lower hole each have a diameter of 0.14 inches plus or minus 20 percent.

Provided last is a J-shaped notch 52. The J-shaped notch extends through the upper plate and the lower plate and the C-shaped bend at the rearward edge in the bottle-opener section. The upper plate and the lower plate and the C-shaped bend are spaced by 0.110 inches plus or minus 20 percent. The upper and lower plates are fabricated of 20 gauge stainless steel. A supplemental hole 54 is provided extending through the upper and lower plates are provided adjacent to the right edge for coupling to a key chain.

The linear rearward edge 26 is continuously linear from the left edge 28 to the right edge 30 except for the J-shaped notch 52 where a portion of the U-shaped bend 42 and portions of the upper plate 20 and lower plate 22 have been removed.

The sinusoidal forward edge 24 is continuously curving with a first convex extent in the whistle section 36 having a first radius of curvature. A second convex extent in the bottle opener/handle section 38 having a second radius of curvature. The second radius of curvature is greater than the first radius of curvature to facilitate handling during use.

The whistle/bottle opener system is fabricated of a rigid material. The rigid material is chosen from the class of rigid materials including metal, plastic, and composite materials. The preferred material for the whistle is a 20 gauge stainless steel.

When used as a whistle, the whistle section is adapted to be held by the lips of the user. The upper and lower holes are interior of the lips. The forward edges of the upper and lower plates are forward of the lips. The tongue of the user is in contact with the rearward edges of the upper and lower plates. In this manner, a flow of air generated by the user will travel through the upper hole and the lower hole along the space between the upper and lower plates and the flow of air will travel out of the whistle and out of the mouth of the user into the atmosphere to cause a loud sound. While functioning as a whistle, the bottle-opener section is adapted to be held as a handle. When functioning as a bottle-opener, the whistle section is adapted to be held as a handle.

A whistle is a uniquely shaped device that when blown into creates loud harmonic tones. The whistle of the present invention does all the above, but with more sound, much more sound. Warning! Do not use indoors, in cars, trains, or planes. Caution! The user may need ear protection. Use with CAUTION and WASH before using. Ideas for use include football games, soccer games, survival use, military purposes, needing attention, and party atmosphere. Please blow responsibly.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A whistle/bottle opener system (10), the system constituting a whistle when supported between lips (12) of a user adjacent to a tongue (14) of the user while flowing a stream of air (16) through the whistle and out of a mouth of the user, the system also constituting a bottle opener, the system comprising, in combination:

an upper plate (20) and a similarly configured lower plate (22), the upper and lower plates each having an entirely serpentine forward edge (24) and a linear rearward edge (26), a left edge (28) and a right edge (30), and an upper surface (32) and a lower surface (34), the upper and lower plates each having a whistle section (36) and a laterally spaced bottle-opener/handle section (38), the forward edges being convex in an arcuate configuration with a first radius of curvature and a maximum distance of 0.875 inches between the forward and rearward edges in the whistle section, the forward edges being convex in an arcuate configuration with a second radius of curvature greater than the first radius of curvature and a maximum distance of 0.750 inches between the forward and rearward edges in the bottle-opener/handle section, the length of the bottle-opener/handle section being between 25 percent and 35 percent greater than the whistle section;

a C-shaped bend (42) coupling the rearward edges of the upper and lower plates, the upper plate and the lower plate and the C-shaped bend being formed from a sheet of 20 gauge stainless steel cut and folded with the upper plate and lower plate parallel with respect to each other;

an upper hole (46) extending through the upper plate in the whistle section and an axially aligned lower hole (48) extending through the lower plate in the whistle section, the upper hole and the lower hole each having a circular configuration with a diameter of 0.14 inches plus or minus 20 percent;

a J-shaped notch (52) extending through the upper plate and the lower plate and the C-shaped bend at the rearward edge in the bottle-opener/handle section, the upper plate and the lower plate and the C-shaped bend being spaced by 0.110 inches plus or minus 20 percent, the upper and lower plates being fabricated of 20 gauge stainless steel, a supplemental hole (54) extending through the upper and lower plates adjacent to the right edge for coupling to a key chain;

the linear rearward edge (26) being continuously linear from the left edge (28) to the right edge (30) except for the J-shaped notch (52) where a portion of the C-shaped bend (42) and portions of the upper plate (20) and lower plate (22) have been removed;

the sinusoidal forward edge (24) being continuously curving with a first convex extent in the whistle section (36) having a first radius of curvature, and with a second convex extent in the bottle opener/handle section (38) having a second radius of curvature, the second radius of curvature being greater than the first radius of curvature to facilitate handling during use.

* * * * *